US005481339A

United States Patent [19]

De Cock et al.

[11] Patent Number: 5,481,339

[45] Date of Patent: Jan. 2, 1996

[54] AIR CONDITIONING DEVICE FOR A PRINTER

[75] Inventors: Etienne M. De Cock; Lucien A. De Schamphelaere, both of Edegem; Johan D. G. Elsermans, Antwerpen; Ludo Verluyten, Holsbeek, all of Belgium

[73] Assignee: Xeikon NV, Mortsel, Belgium

[21] Appl. No.: 257,048

[22] Filed: Jun. 8, 1994

[30] Foreign Application Priority Data

Jun. 18, 1993 [EP] European Pat. Off. ..... 93304775

[51] Int. Cl.[6] ..... G03G 21/20

[52] U.S. Cl. ..... 355/215; 355/245

[58] Field of Search ..... 355/30, 200, 215, 355/245; 15/301; 454/49, 56, 184, 186

[56] References Cited

U.S. PATENT DOCUMENTS

| | | | |
|---|---|---|---|
| 3,685,485 | 8/1972 | Kutsuwada et al. | 355/215 X |
| 3,914,046 | 10/1975 | Tanaka et al. | 355/297 |
| 3,997,262 | 12/1976 | Doi et al. | 355/210 |
| 4,045,135 | 8/1977 | Doi et al. | 355/271 |
| 4,093,368 | 6/1978 | Nishikawa | 355/215 X |
| 4,154,521 | 5/1979 | Tanaka | 355/215 |
| 4,178,092 | 12/1979 | Yamamoto et al. | 355/200 |
| 4,727,385 | 2/1988 | Nishikawa et al. | 346/153 |
| 4,968,993 | 11/1990 | Wolfberg et al. | 347/118 |
| 5,028,959 | 7/1991 | Gooray | 355/215 |
| 5,038,170 | 8/1991 | Serita | 355/200 |
| 5,073,796 | 12/1991 | Suzuki et al. | 355/215 |

FOREIGN PATENT DOCUMENTS

| | | | |
|---|---|---|---|
| 1216018 | 12/1986 | Canada . | |
| 0255676 | 10/1988 | European Pat. Off. . | |
| 53-3240 | 1/1978 | Japan | 355/215 |
| 59-81673 | 5/1984 | Japan . | |
| 59-107368 | 6/1984 | Japan . | |
| 60-3678 | 1/1985 | Japan . | |
| 61-55666 | 3/1986 | Japan | 355/215 |
| 62-194271 | 8/1987 | Japan | 355/215 |

OTHER PUBLICATIONS

"Air Conditioning of Xerographic Reproduction Machines" by C. D. Wilson; vol. 1, No. 7, Jul. 1976, p. 69, Xerox Disclosure Journal.

"Combination Filter Bag/Ozone Eliminator" by H. Ring, Xerox Disclosure Journal, vol. 4, No. 7, Jul./Aug. 1979, p. 529.

"Photoconductor Heater Control" by R. W. Huffman, IBM Technical Disclosure Bulletin vol. 19, No. 4, Sep. 1976, p. 1151.

*Primary Examiner*—William J. Royer

*Attorney, Agent, or Firm*—Brumbaugh, Graves, Donohue & Raymond

[57] ABSTRACT

An electrostatographic printer is described for forming an image onto a moving web or sheet. The printer includes a number of toner image-producing electrostatographic stations having rotatable drums onto which a toner image can be formed. A development station forms a toner image on the drums. Drive rollers convey the web past the image-producing stations. Corona discharge devices transfer the toner image on the drum surface onto the moving web. The printer also has an air-conditioning device which has filters for removing dust and ozone from air leaving the environment of the image-producing station, a heat exchanger and a humidifier for adjusting the temperature and humidity of air leaving the environment of the image-producing station, and an inlet manifold for introducing a stream of the conditioned clean air into the environment of the image-producing stations.

20 Claims, 4 Drawing Sheets

AIR CONDITIONING DEVICE FOR A PRINTER

FIELD OF THE INVENTION

This invention relates to an electrostatographic printer for forming an image onto a moving receptor element, in particular to such a printer for forming multi-colour images on a paper web.

An electrostatographic printing apparatus is intended for making a large number of prints and finds use, e.g., in the field wherein classical offset printing machines are applied for making thousands of prints in a single run.

BACKGROUND OF THE INVENTION

Electrostatographic printing operates according to the principles and embodiments of non-impact printing as described, e.g., in "Principles of Non-Impact Printing" by Jerome L. Johnson (1986)-Palatino Press-Irvine Calif., 92715 U.S.A.).

Electrostatographic printing includes electrographic printing in which an electrostatic charge is deposited image-wise on a dielectric recording member as well as electrophotographic printing in which an overall electrostatically charged photoconductive dielectric recording member is image-wise exposed to conductivity increasing radiation producing thereby a "direct" or "reversal" toner-developable charge pattern on said recording member. "Direct" development is a positive-positive development. "Reversal" development is of interest in or when from a negative original a positive reproduction has to be made or vice-versa, or when the exposure derives from an image in digital electrical signal form, wherein the electrical signals modulate a laser beam or the light output of light-emitting diodes (LEDs). It is advantageous with respect to a reduced load of the electric signal modulated light source (laser or LEDs) to record graphic information (e.g. printed text) in such a way that the light information corresponds with the graphic characters so that by "reversal" development in the exposed area of a photoconductive recording layer, toner can be deposited to produce a positive reproduction of the electronically stored original. In high speed electrostatographic printing the exposure derives practically always from electronically stored, i.e. computer stored, information.

A review of different toner development systems is given by Thomas L. Thomson in I.E.E.E. Transactions on Electronic Devices, Vol ED 19, pp 495 to 511.

The toner image obtained on a repeatedly used electrostatographic dielectric recording member is transferred onto a printing stock material, usually paper in the form of a web whereon the toner image is fixed, whereupon the web is cut into sheets containing the desired print frame.

As can be learned from the book "The Physics and Technology of Xerographic Processes" by E. M. Williams (1984), Chapter Ten, p204 and seq, the transfer of developed toner images onto paper proceeds by means of electrical corona devices to generate the required electric field to attract the charged toner from the electrostatographic recording member to the paper. The transfer efficiency of toner onto the receptor paper is not only dictated by the contact of the paper with the toner-laden recording member and the corona voltage but also by the conductivity of the paper and particularly by its water content. Paper is not a simple insulating dielectric, so the electrical properties of plain paper have some influence on toner transfer.

Experiments with a variety of paper types and thicknesses (i.e. weights) have established that heavier papers yield improvement in transfer efficiency. Paper types with high porosity, ie high permeability for gases loaded with ions by corona discharge do not allow an efficient toner transfer. Variation in gas permeability or porosity between different paper types is due to overall thickness, degree of filling with sizing agents such as clays, gloss-improving agents and other treatment agents.

Apart from these agents which form a constant factor for conductivity there is the moisture content which fluctuates with the humidity of the environment.

It has been established that as the moisture content of untreated copy paper increases from about 3 to 10% by weight, the surface resistance of said paper decreases nearly six orders in magnitude. Dry paper has very good electric insulating behaviour so that thereon by corona discharge a fairly high electrostatic charge can be deposited before breakdown takes place. On using dry receptor paper the toner attraction force caused by an electrostatic charge at the rearside of the receptor paper can be built up with reasonable charge. Since the leakage of charges flowing through the receptor paper is a function of moisture content (paper humidity), a careful control of said moisture content will be in favour of toner transfer efficiency, image quality and reproducibility in toner printing results.

A careful control of the relative humidity and temperature of the toner in the development station and more particularly of the environment wherein the development takes place will avoid substantial fluctuations in charge/mass (Q/M) ratio of the individual toner particles, which Q/M ratio substantially determines the optical density of the developed and transferred toner image.

The humidity of the environment wherein corona discharge takes place will also determine the ionisation degree and ion charge deposition. A high humidity seriously influences the functioning of corona discharge devices and too high a humidity may give rise to undesirable electric breakdown phenomena.

The humidity of the printer environment has also been found to have an influence upon dimensional stability of the web. This stability is particularly important in multi-station printers where accurate registration of superimposed images is critical.

According to published European patent application 0 154 041 (AGFA-GEVAERT/De Schamphelaere et al), the temperature of the photoconductive layer of an electrophotographic apparatus has to be kept as constant as possible in order to avoid changes in chargeability and discharge characteristics of the photoconductive layer. In order to obtain reproducible printing results under varying temperature conditions of the photoconductive layer a temperature sensing means in the immediate neighbourhood of the photoconductive layer produces electrical signals that are used in a comparator circuit to control the development regulating bias voltage applied during development to a magnetic brush loaded with carrier-toner mixture.

U.S. Pat. No. 5,034,772 (Susuki, assigned to Canon KK) relates to an electrophotographic apparatus containing a humidity measurement device and means for compensating for image forming condition variations caused by changes in humidity. Said compensating means represent a number of electronic control means and circuits that are activated by a temperature/humidity detection means located near the recording member, but do not create stable temperature/humidity conditions.

Another important aspect inseparable from corona discharge in the air is the formation of ozone, the concentration of which must be kept below a certain level in the neighbourhood of the coronas in order to maintain stable charging capacity and to prevent chemical attack of the applied photoconductive substances and/or organic binder therefor. Moreover, in the surroundings of the printing apparatus the ozone concentration may not surpass a level that could pose a health risk for the operating personnel. Therefore, measures to destroy and/or absorb ozone formed in corona-operated electrostatographic printing machines (particularly for high impression numbers) should preferably be taken.

Printing machines of the type described herein are liable to generate dust, primarily toner dust from the development station, but also paper dust. The presence of dust may seriously influence the image writing systems and the corona discharge devices in the printer. It is therefore desirable to reduce the level of dust in the environment of the printer.

SUMMARY OF THE INVENTION

It is an object of the present invention to provide an electrostatographic printing apparatus incorporating means capable of continuously creating a substantially stable gaseous condition of humidity and temperature in the immediate neighbourhood of the imaging, toner development and toner transfer stations of the apparatus, whereby image quality deviations of electrostatographic prints are reduced or avoided and dimensional stability of the receptor medium can be assured.

It is another object of the present invention to provide an electrostatographic printing method for reproducible production of dry toner images particularly on paper receptor element supports.

It is a preferred object of the invention to reduce the levels of ozone and dust in the environment of the printer, to thereby improve the reliability and lifetime of the system components and to reduce the level of ozone expelled to the atmosphere.

According to a first aspect of the invention there is provided an electrostatographic printer for forming an image onto a moving receptor element, which printer comprises:

(i) a toner image-producing electrostatographic station having rotatable endless surface means onto which a toner image can be formed;

(ii) development station for forming a toner image on said endless rotatable surface means;

(iii) means for conveying the moving receptor element past said image-producing station;

(iv) means for transferring the toner image on said rotatable surface means onto the moving receptor element; and (v) an air-conditioning device comprising means for adjusting the temperature and humidity of air to produce conditioned air, and means for introducing a stream of said conditioned air into the environment of the imageproducing station, wherein air leaving the environment of the image-producing station is recycled and reconditioned by the air-conditioning device.

According to a second aspect of the invention, there is provided a method for forming an image onto a moving receptor element in an electrostatographic printer which includes a toner image-producing electrostatographic station having rotatable endless surface means onto which a toner image can be formed, the method comprising:

forming a toner image on said endless rotatable surface means;

conveying the receptor element past said image-producing station;

transferring the toner image on said rotatable surface means onto the moving receptor element;

adjusting the temperature and humidity of air to produce conditioned air, introducing a stream of said conditioned air into the environment of the image-producing station, recycling air leaving the environment of the image-producing station, and re-conditioning the air recylced from the environment of the image-producing station.

The receptor element may be in web or sheet form and may constitute a final support for the toner image or a temporary support, as explained in more detail below.

Usually, the endless surface means is formed by the circumferential surface of a drum, although it is also possible to use an endless belt. In the following general description, reference is made to a drum, but it is to be understood that such references are also applicable to endless belts or to any other form of endless surface means.

In preferred embodiments of the invention, the air-conditioning device further comprises means for removing dust and ozone from air leaving the environment of the image-producing station.

In a preferred embodiment of the invention, the means for removing dust from air leaving the environment of the or each image-producing station further comprises a dust-retaining filter. Such a filter is ideally capable of removing particles of a size above 1.0 μm.

The means for removing ozone from air leaving the environment of the or each image-producing station may comprise an ozone-sorption device or an ozone-decomposing device. An ozone-decomposing device is for example of the type where ozone is catalytically decomposed, as described in U.S. Pat. No. 4,680,040 (Gooray et al assigned to Xerox Corporation), particularly such a device which uses metal oxide as the catalytic medium.

Preferably, the image-producing station(s) is (are) housed in a cabinet having at least one inlet for said conditioned air and at least one outlet for air containing dust and ozone.

The air-conditioning device may further comprise sensing means for providing signals indicative of the temperature and humidity of air leaving the environment of the or each image-producing station. The output from the sensor may be fed to a visual indicator from which the operator may check the condition of the environment air and make adjustments to the air conditioning device as necessary to bring the environmental condition within a desired range. Alternatively, electronic control means may be provided to automatically adjust the conditioning of the air in accordance with the signals produced by the sensor.

Preferably, the means for adjusting the temperature and humidity of air leaving the environment of the or each image-producing station comprises a cooling unit. The cooling unit may be in the form of a heat-exchanger operating with cold water, the temperature of the incoming water being controlled by a refrigeration device, in response to signals generated by the sensor. The cooling unit may be provided with a reservoir to collect condensed water which is then led to a drain. Two devices may be used, the first serving to cool the circulating air sufficiently to cause the condensation of moisture, to bring the moisture content thereof to a desired level. Where the low temperature required to achieve this drying effect is below the reference temperature of the circulating air, the second device may be used to raise the temperature of the circulating air to the desired level.

The desired humidity of the conditioned air implies a specific dew point. The conditioning method may include reducing the temperature of the air to be conditioned to the dew point, saturating the air with water at this temperature and subsequently raising the temperature to the desired level, thereby to generate conditioned air with a controlled humidity without the need for sensing the humidity of the air to be conditioned.

Preferably, the air-conditioning device includes an inlet manifold for introducing a stream of the conditioned air into the environment of each image-producing station. Alternatively, or in addition, where a plurality of image-producing stations (A to E') are housed in a cabinet, said air-conditioning device may include a common inlet for introducing a stream of said conditioned air into said cabinet. Similarly, the air-conditioning device may include an outlet manifold for removing air from the environment of each image-producing station.

The means for introducing a stream of the conditioned air into the environment of the or each image-producing station may be so constructed and positioned to direct the conditioned air towards the drum surface at a position adjacent the development station. This ensures that the conditioned air forms a working environment for the elements of the image-producing station(s).

The means for removing dust and ozone from air leaving the environment of the or each image-producing station is preferably so constructed and positioned to remove the air from the vicinity of the development station. Preferably, the development station is located within a development station box, the box having an outlet for the removal of the air therefrom. By this means the inadvertent deposit of toner particles on various parts of the apparatus can be substantially avoided, particularly if air is removed through this outlet under suction. The development station box may further comprise an inlet for introducing a stream of the conditioned air. This ensures that the environment of the development station is specifically controlled. The importance of this is based on the finding that the efficiency of toner development depends, in particular, upon the moisture content of the environment. Indeed, in a preferred embodiment of the invention, air of a first condition may be introduced directly to each development station while air of a second condition may be introduced simultaneously via a common inlet into the cabinet of the printer. In this embodiment, the air introduced directly into the development stations may have a relative humidity of from 30% to 40%, while that introduced into the cabinet may have a lower relative humidity of from 25% to 35%. This differential air conditioning may be achieved in a simple manner by dividing the incoming air into two streams, increasing the moisture content of the stream passing directly to the development stations and/or reducing the moisture content of the stream passing to the printer cabinet.

The air-conditioning device is preferably capable of maintaining the air introduced from the inlet manifold at a temperature of from 20° to 30° C., a humidity of from 20% to 40%, an ozone concentration within the printer of below 5.0 ppm, and an ozone concentration in any exhaust gas of below 0.05 ppm.

The means for transferring the toner image on the surface of the drum onto the moving receptor element may be formed by a corona discharge device of the DC type, which sprays particles having a charge opposite to that of the toner particles. The supply current fed to the corona discharge device is preferably within the range of 1 to 10 μA/cm, most preferably from 2 to 5 μMA/cm, depending upon the paper characteristics and will be positioned at a distance of from 3 mm to 10 mm from the path of the web.

In one embodiment of the invention, the web is a final support for the toner images and is unwound from a roll, fixing means being provided for fixing the transferred images on the web. In this embodiment, the printer may further comprise a roll stand for unwinding a roll of web to be printed in the printer, and a web cutter for cutting the printed web into sheets. The drive means for the web may comprise one or more drive rollers, preferably at least one drive roller being positioned downstream of the image-producing stations and a brake or at least one drive roller being positioned upstream of the image forming stations. The speed of the web through the printer and the tension therein is dependent upon the torque applied to these drive rollers. By the provision of two drive rollers, upstream and downstream of the image forming stations, tension in the web may be controlled by applying a different torque to these drive rollers. Preferably the web is conveyed through the printer at a speed of from 5 cm/sec to 50 cm/sec and the tension in the web at each image-producing station preferably lies within the range of 0.2 to 2.0 N/cm.

In another embodiment, the printer is adapted to utilise receptor material in sheet form, such as is described in U.S. Pat. No. 5,187,536 (Hasegawa et al assigned to Canon Kabushiki Kaisha).

In an alternative embodiment of the invention, the web is a temporary support in the form of a tensioned endless belt. Such a printer may further comprise transfer means for transferring the images formed on the belt onto a final support, fixing means being provided for fixing the transferred images on the final support. In this embodiment, the final support may be in web or sheet form.

The printer construction according to the invention is particularly advantageous where the printer is a multi-station printer, for example a multi-colour printer comprising cyan, yellow, magenta and black printing stations. A separate black image-printing is preferred since the merging of yellow, cyan and magenta may not yield black of a hue which is as satisfactory as pure black, depending upon the nature of the toners being used.

In a preferred embodiment of the invention, the stations are arranged in two sub-groups, the drums of one sub-group forming the guide roller means for the other sub-group, and vice-versa, thereby to enable simultaneous duplex printing. In such an embodiment, image(s) are transferred to a first side of the web by one or more image-producing stations, image(s) are then transferred to the opposite side of the web by one or more further image-producing stations and thereafter further image(s) are formed on the first side of the web again by one or more still further image-producing stations. Such an arrangement is referred to as a "staggered" arrangement and the most preferred embodiment of a staggered arrangement is where the image-producing stations are located alternately on opposite sides of the web.

PREFERRED EMBODIMENTS OF THE INVENTION

The invention will now be further described, purely by way of example, with reference to the accompanying drawings, in which.

Figure 1:
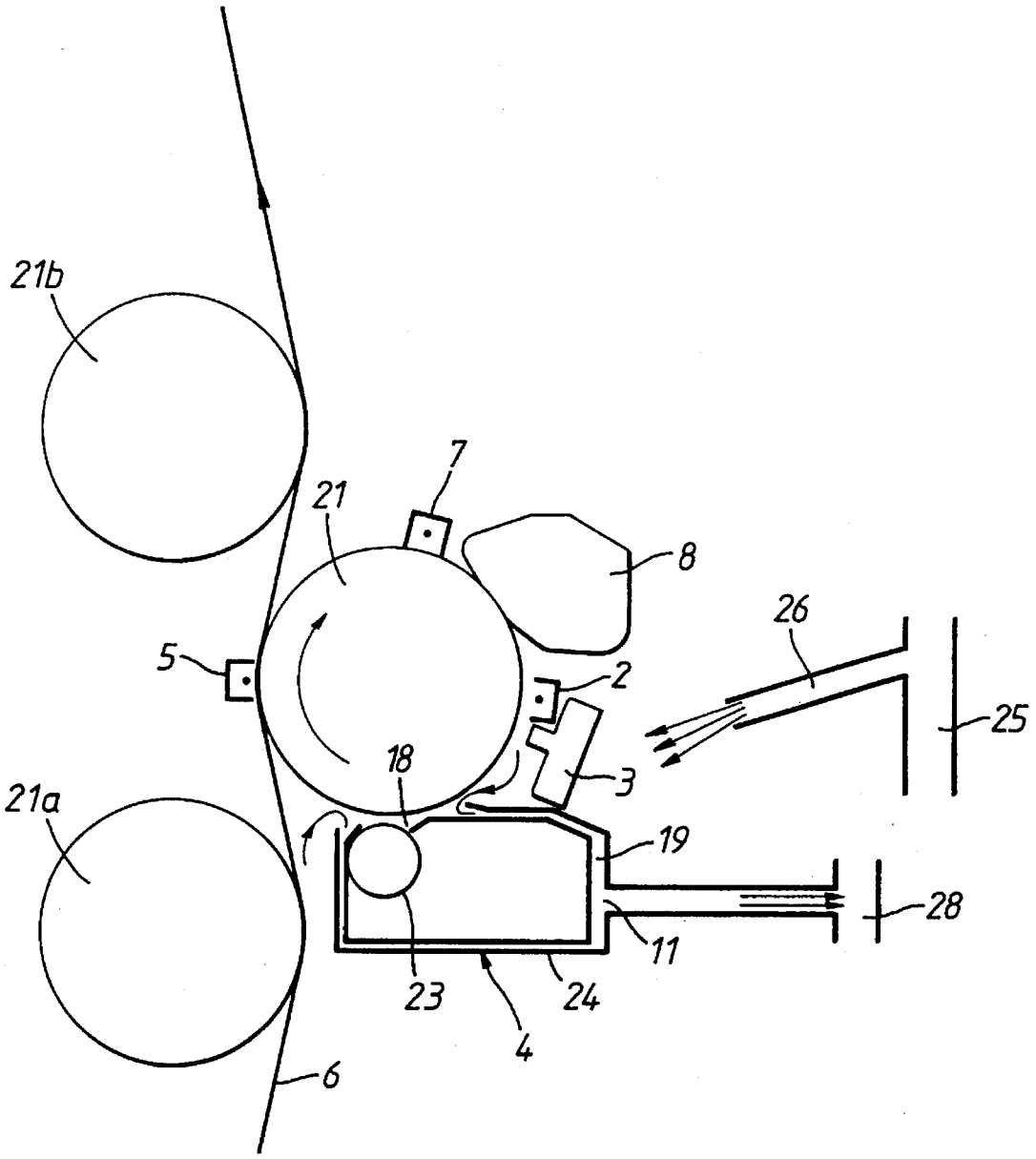
FIG. 1 is a diagrammatical cross-section showing one image-producing station of the multi-station duplex printer represented in FIG. 2.

As shown in FIG. 1, each printing station comprises a cylindrical drum 21 having a photoconductive outer surface. The drum 21 is rotated in the indicated direction. Circumferentially arranged around the drum 21 there is a main corotron or scorotron charging device 2 capable of uniformly charging the drum surface, for example to a potential of about −600 V, an exposure station 3 which may, for example, be in the form of a scanning laser beam or an LED array, which will image-wise and line-wise expose the photoconductive drum surface causing the charge on the latter to be selectively dissipated, for example to a potential of about −250 V, leaving an image-wise distribution of electric charge to remain on the drum surface. This so-called "latent image" is rendered visible by a development station 4 which by means known in the art will bring a developer in contact with the drum surface. The development station 4 includes a magnet brush 23 which is adjustably mounted, enabling it to be moved radially towards or away from the drum 21. According to one embodiment, the developer contains (i) toner particles containing a mixture of a resin, a dye or pigment of the appropriate colour and normally a charge-controlling compound giving triboelectric charge to the toner, and (ii) carrier particles charging the toner particles by frictional contact therewith. The carrier particles may be made of a magnetisable material, such as iron or iron oxide. In a typical construction of a developer station, the developer drum 23 contains magnets carried within a rotating sleeve causing the mixture of toner and magnetic material to rotate therewith, to contact the surface of the drum 21 in a brush-like manner. The toner particles are charged to a certain charge of, for example 10 μC/g and are attracted to the latent image on the drum surface by the electric field between the drum surface and the developer so that the latent image becomes visible.

After development, the toner image adhering to the drum surface is transferred to the moving web 6 by a transfer corona device 5. The moving web 6 is in face-to-face contact with the drum surface over a wrapping angle of about 15° determined by the position of adjacent drums 21*a* and 21*b*. The transfer corona device, being on the opposite side of the web to the drum, and having a high potential opposite in sign to that of the charge on the toner particles, attracts the toner particles away from the drum surface and onto the surface of the web 6. The transfer corona device typically has its corona wire positioned about 7 mm from the housing which surrounds it and 7 mm from the paper web. A typical transfer corona current is about ±3 μA/cm. The transfer corona device 5 also serves to generate a strong adherent force between the web 6 and the drum surface, causing the latter to be rotated in synchronism with the movement of the web 6 and urging the toner particles into firm contact with the surface of the web 6.

Thereafter, the drum surface is pre-charged to an intermediate level of, for example −580 V, by a scorotron pre-cleaning corona device 7, causing any residual toner which might still cling to its surface to become loosened so that it may be collected at a cleaning unit 8 known in the art. The cleaning unit 8 includes an adjustably mounted cleaning brush (not shown), the position of which can be adjusted towards or away from the drum surface to ensure optimum cleaning. The cleaning brush is earthed or subject to such a potential with respect to the drum as to attract the residual toner particles away from the drum surface. After cleaning, the drum surface is ready for another recording cycle.

Figure 2:
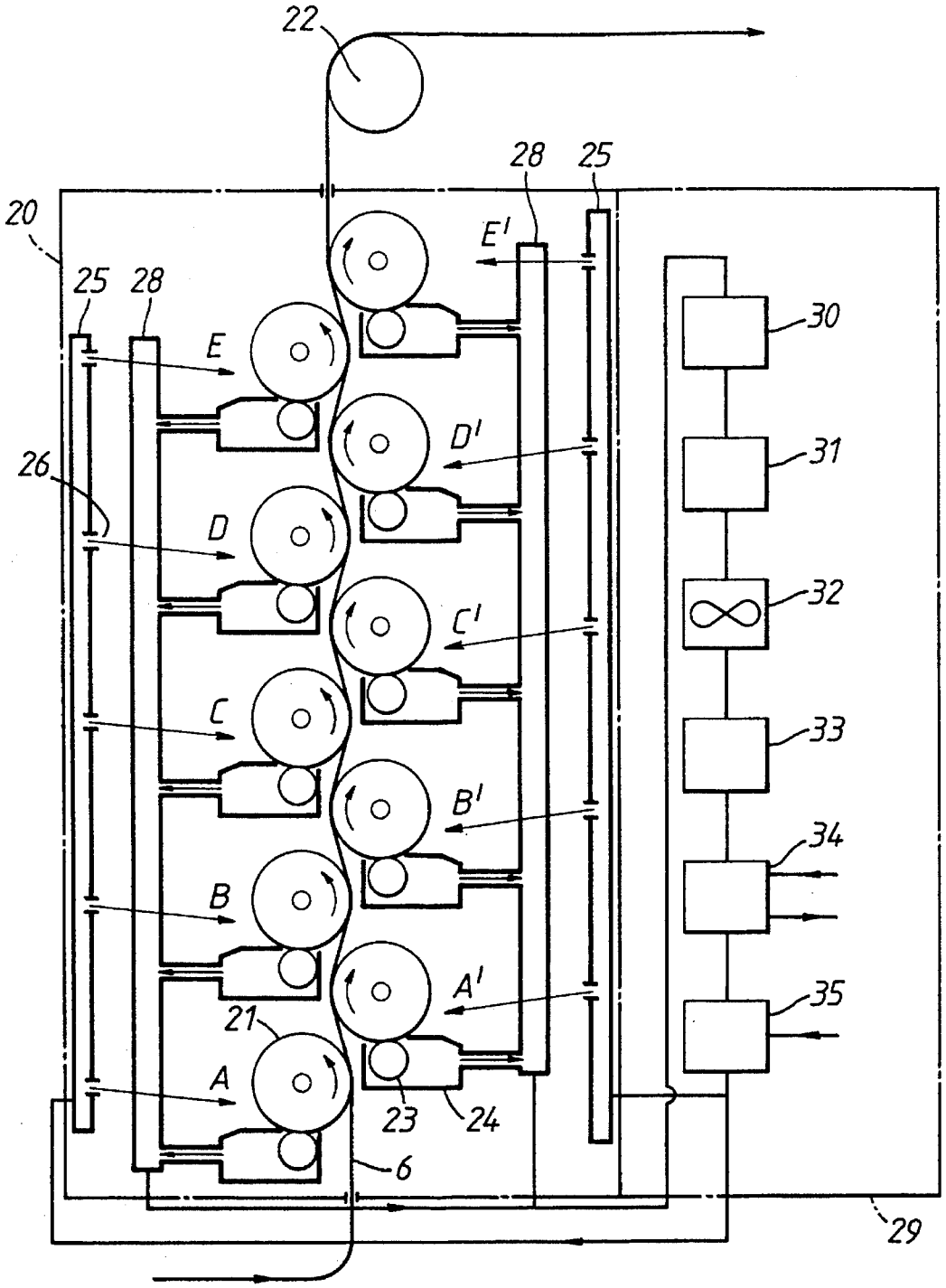
FIG. 2 is a diagrammatical cross-sectional view of a printer having air inlets at both sides of the web and of which a part is shown in FIG. 1.

Through the slit-shaped nozzles 26 of an inlet manifold 25 (only a part of which is shown in FIG. 1) a temperature and humidity conditioned stream of air is blown in the direction of one side of the web 6 to immerse the respective image-producing station in said air. The development station 4 is housed in a double-walled box 24 having an outlet 11 through which air is withdrawn under suction into an outlet manifold 28. The development box 24 includes an opening 18 facing the drum 21 in which opening the magnetic brush 23 is located. As indicated by the bent arrows in FIG. 1, at this opening 18 air enters the space 19 between the inner and outer walls of the development box 24 entraining toner particle dust which would otherwise be free to drift about inside the printing cabinet 20 (as shown in FIG. 2) to become inadvertently deposited on various parts of the printer, risking the production of poor print quality. The space 19 has an outlet 11 leading to the manifold 28. The double-walled construction of the development station 4 also has the advantage that the temperature in the development station can be kept in a relatively stable, cool condition.

It is possible for the cleaning station 8 to be constructed in a similar double-walled manner, to provide withdrawal of toner dust-laden air at this location also.

Referring to FIG. 2, after passing a first printing station A, the web passes successively to printing stations B, C, D and E, where images in other colours are transferred to the web 6. In FIG. 2, some details of each image-producing station are omitted for the sake of clarity. It is critical that the images produced in successive stations be in register with each other. In order to achieve this, the start of the imaging process at each station has to be critically timed. Accurate registering of the images is possible only if there is no slip between the web 6 and the surface of the drum 21 at each image-producing station. Accurate registration is also assisted by ensuring constant environmental conditions at each of the image-producing stations, by use of the present invention.

The printer in FIG. 2 comprises ten printing stations which are arranged in two sub-groups, the drums of one sub-group A, B, C, D and E forming backing rollers for the other sub-group A', B', C', D' and E', and vice-versa, thereby to enable duplex printing. The first four drums of each sub-group are arranged to print yellow, magenta, cyan and black on the web. The final stations E and E' are provided in order to optionally print an additional colour, for example a specially customised colour. Each image-producing station A to E and A' to E' is mounted in a substantially vertical orientation resulting in a reduced footprint of the printer and additionally making servicing easier. The associated stations A to E and A' to E' are oriented in a horizontal position, so that the chances for dust contamination during filling with toner are drastically reduced.

The web 6 of paper unwound from a supply roller (not shown) is conveyed in an upwards direction past the image-producing stations in turn. We prefer that the paper web is pre-conditioned before entering the printer, by controlling the moisture content of paper to increase its electrical volume resistivity to at least $10^{10}$ ohm.m, preferably at least $5\times10^{10}$ ohm.m. The web 6 is conveyed through the printer by drive roller(s) 22. The printer is housed in a cabinet 20.

After passing the last image-producing station E', the web 6 of paper passes through fixing, cooling and cutting stations (not shown), positioned outside the cabinet 20.

On both sides of the paper web 6, a hollow plate-like air inlet manifold 25 is provided, having slit-like outlets 26 through which fresh conditioned air is blown into the cabinet 20, in the direction of the development zone. After forming a conditioned environment for the image-producing stations the air which is now loaded with toner dust and ozone is sucked away through outlets 11 (see FIG. 1) in the development boxes 24. The outlets 11 lead to one of two outlet manifolds 28 provided one on each side of the web 6.

A cabinet 29, coupled to the printer cabinet 20, houses the control elements of an air conditioning device. The outlet manifolds 28 lead, via a common line in turn to a dust filter 30, a temperature and humidity sensor 31, a high pressure blower 32, an ozone filter 33, a cooling device 34 and a humidifier 35. The dust filter 30 comprises a fibrous filter medium to retain particles larger than 1 μm. The high pressure blower 32 has a capacity of about 120 $m^3$/hour. The ozone filter 33 is for example type SCH-813 commercially available from Sakai Chemical Corporation, Japan, which uses a metal oxide as the catalytic medium.

The cooling device 34 is in the form of a heat-exchanger operating with cold water, the temperature of the incoming water being controlled by a refrigeration device (not shown), in response to signals generated by the sensor 31 by means of electronic circuitry well known in the art.

The humidifier 35 is fed with water at a temperature close to that of the conditioned air and, in a manner known in the art, injects moisture at a controlled rate into the conditioned air to increase the humidity thereof as desired. The outlet of the humidifier 35 is connected in parallel to two inlet manifolds 25, one on either side of the web 6, to provide separate streams of conditioned air at each of the image producing stations A to E'. Air leaving the environment of the image-producing stations A to E' through the outlet manifolds 28 is recycled to, and re-conditioned by, the air-conditioning device.

The air-conditioning device is capable of maintaining the air introduced from the inlet manifold 25 at a temperature of 25° C., a humidity of 30%, an ozone concentration at the inlet to the cabinet 20 of below 5.0 ppm and substantially no dust particles having a size above 1.0 μm.

Figure 3:
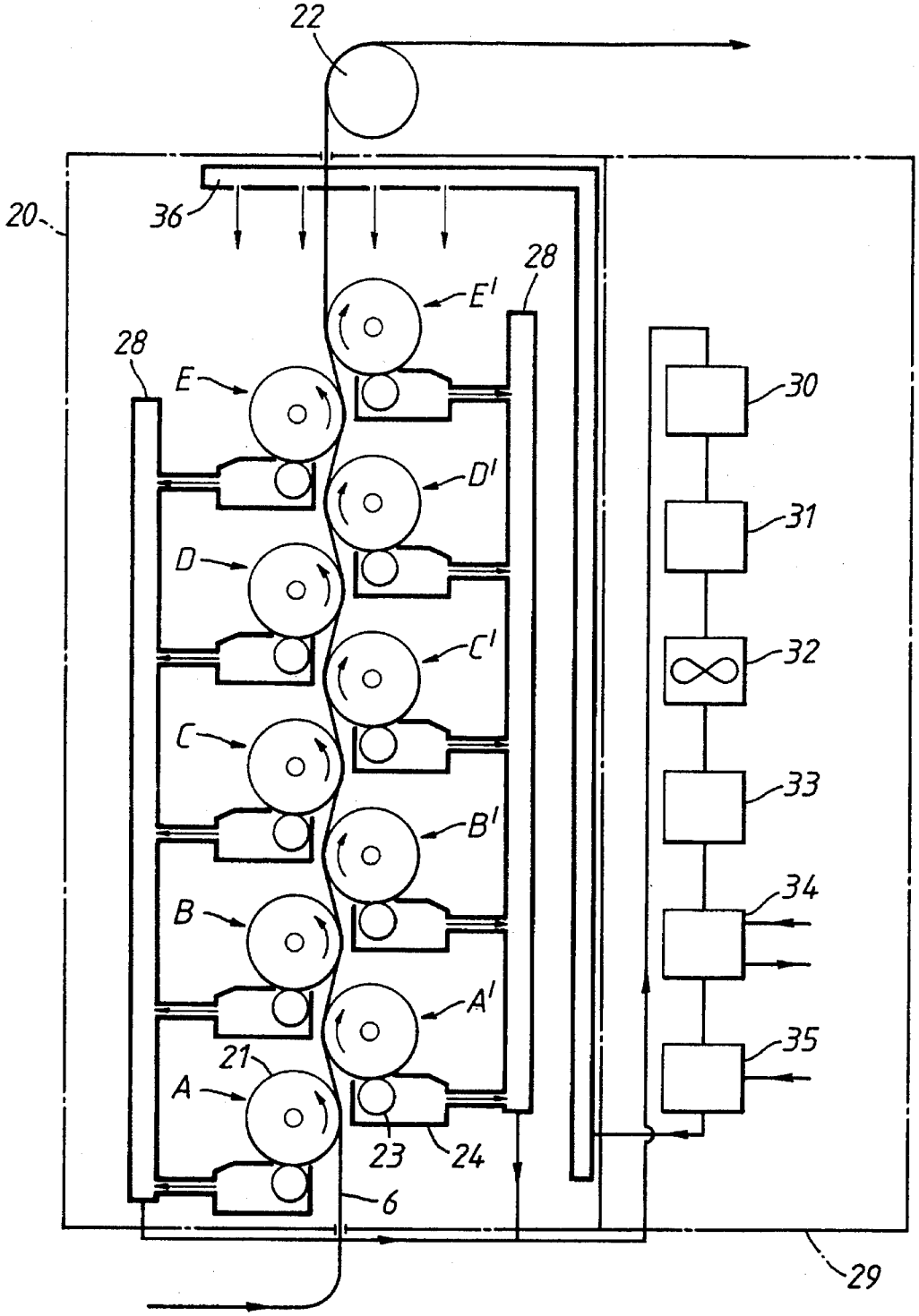
FIG. 3 is a diagrammatical cross-sectional view of a printer according to the invention having an air inlet at the top of the printing cabinet.

The printer shown in FIG. 3 differs from that shown in FIGS. 1 and 2 in that a stream of conditioned air leaving the air-conditioning cabinet 29 passes to a common inlet 36 positioned at the top of the printer cabinet 20. The conditioned air from the common inlet 36 passes through the printer cabinet 20 forming an environment for each image-producing station A to E'. Air is extracted from each development station in the same way as described with respect to FIGS. 1 and 2.

Figure 4:
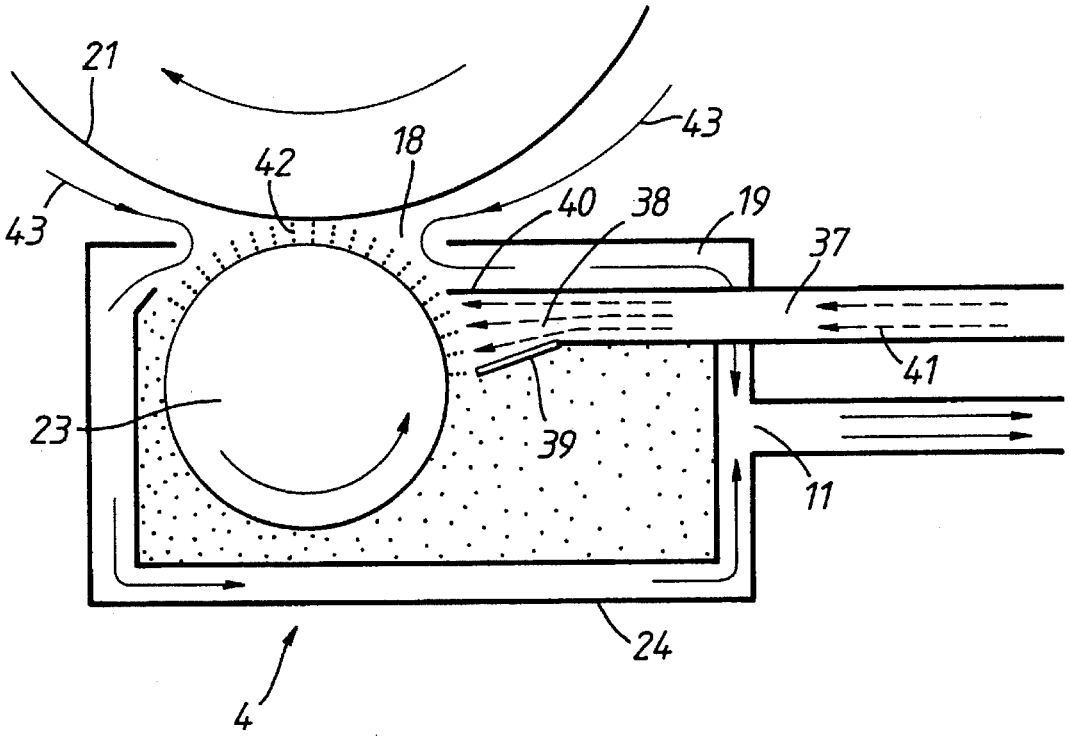
FIG. 4 is a diagrammatical cross-section of an air-conditioned development station for use in a printer according to the invention.

Referring to FIG. 4, the development station 4 is a modified embodiment of the development station of FIG. 1 and comprises an additional channel 37 serving as an inlet for introducing a low speed stream of separately conditioned air (indicated by the dashed line arrows 41). The channel 37 ends in a plate-like nozzle 38 formed by the doctor blade 39 and the upper plate 40 of said channel.

By introducing said separately conditioned air into direct contact with the individual toner particles of the magnetic brush 23 before the developer reaches the development gap 42, an appropriate micro-climate (temperature and relative humidity are different from the air-conditioned environment in the printer cabinet 20) is created. By that micro-climate the charge/mass (Q/M) ratio of the toner particles is adapted for obtaining optimal development results.

The development box 24 includes, as in the development box of FIG. 1, an opening 18 facing the imaging drum 21 from which opening the magnetic brush 23 emerges to bring the toner-laden magnetised carrier particles into contact with the drum surface.

As indicated by the bent full line arrows 43, the air that has been introduced into cabinet 20 (see FIG. 2 introduced sidewardly by manifolds 25 and see FIG. 3 introduced at the top by common inlet 36) enters the space 19 formed by the inner and outer walls of said box 24 and leaves the double walled box through the outlet 11.

According to a preferred embodiment, the development station 4 of FIG. 4 is operated in a printer according to FIG. 3 with a common air inlet at the top of the printing cabinet 20.

CROSS-REFERENCE TO CO-PENDING APPLICATIONS

A number of features of the printers described herein are the subject matter of:

co-pending U.S. patent application Ser. No. 08/257,112 entitled "Electrostatographic single-pass multiple-station printer", co-pending U.S. patent application Ser. No. 08/257,116 entitled "An electrostatographic single-pass multiple station printer for duplex printing", co-pending U.S. patent application Ser. No. 08/257,111 entitled "Electrostatographic single-pass multiple station printer with register control", and co-pending U.S. patent application Ser. No. 08/257,046 entitled "Paper receptor material conditioning apparatus", all filed on Jun. 8, 1994.

We claim:

1. An electrostatographic printer for forming an image onto a moving receptor element, which printer comprises:

(i) a plurality of toner image-producing electrostatographic stations;

(ii) means for conveying the moving receptor element past said image-producing stations, each of said image producing stations having rotatable endless surface means onto which a toner image can be formed, a development station for forming a toner image on said rotatable endless surface means and means for transferring said toner image on said rotatable endless surface means onto said moving receptor element; and (iii) an air-conditioning device comprising means for adjusting the temperature and humidity of air to produce conditioned air, and means for introducing a stream of said conditioned air into the environment of said image-producing stations, wherein air leaving the environment of said image-producing stations is recycled to, and reconditioned by, said air-conditioning device.

2. A printer according to claim 1, wherein said moving receptor element is a paper web.

3. A printer according to claim 1, wherein said air-conditioning device further comprises means for removing dust and ozone from air leaving the environment of said image-producing stations.

4. A printer according to claim 3, wherein said means for removing dust from air leaving the environment of said image-producing stations comprises a dust-retaining filter.

5. A printer according to claim 3, wherein said means for removing ozone from air leaving the environment of said image-producing stations is a device selected from an ozone-sorption and an ozone-decomposing device.

6. A printer according to claim 3, wherein said means for removing dust and ozone from air leaving the environment of each of said image-producing stations is so constructed and positioned to remove said air from the vicinity of said development station.

7. A printer according to claim 6, wherein each of said development stations comprises a development station box, said box having an outlet for the removal of said air therefrom.

8. A printer according to claim 7, wherein said development station box further comprises an inlet for introducing a stream of separately conditioned air.

9. A printer according to claim 8, wherein said plurality of image-producing stations are housed in a cabinet, said air-conditioning device including a common inlet for introducing a stream of said conditioned air into said cabinet, and wherein said air-conditioning device further comprises means for introducing a stream of air of a first condition directly to each development station and means for introducing air of a second condition simultaneously via a common inlet into said cabinet of said printer.

10. A printer according to claim 1, wherein said image-producing stations are housed in a cabinet having at least one inlet for said conditioned air and at least one outlet for air containing dust and ozone.

11. A printer according to claim 1, wherein said air-conditioning device further comprises sensing means for providing signals indicative of the temperature and humidity of air leaving the environment of said image-producing stations.

12. A printer according to claim 1, wherein said means for adjusting the temperature and humidity of air comprises a cooling unit.

13. A printer according to claim 12, wherein said cooling unit contains, as a cooling medium, water which is kept at a reference temperature by means of a refrigeration device.

14. A printer according to claim 1, wherein said air-conditioning device includes an outlet manifold for introducing a separate stream of said conditioned air into the environment of each of said image-producing stations.

15. A printer according to claim 1, wherein said plurality of image-producing stations are housed in a cabinet, said air-conditioning device including a common inlet for introducing a common stream of said conditioned air into said cabinet.

16. A printer according to claim 1, wherein said air-conditioning device includes an outlet manifold for removing air from the environment of each of said image-producing stations.

17. A printer according to claim 1, wherein said means for introducing a stream of said conditioned air into the environment of said image-producing stations is so constructed and positioned to direct said conditioned air towards said rotatable endless surface means at a position adjacent said development station.

18. A printer according to claim 1, wherein each said development station has a double-walled construction.

19. A method for forming an image onto a moving receptor element in an electrostatographic printer which includes a plurality of toner image-producing electrostatographic stations, each of said image-producing stations having rotatable endless surface means onto which a toner image can be formed, the method comprising:

forming a toner image on each of said rotatable endless surface means;

conveying said moving receptor element past said image-producing stations;

transferring said toner image on each of said rotatable endless surface means onto said moving receptor element;

adjusting the temperature and humidity of air to produce conditioned air, introducing a stream of said conditioned air into the environment of said image-producing stations, recycling air leaving the environment of said image-producing stations, and re-conditioning the air recycled from the environment of said image-producing stations.

20. A method according to claim 19, wherein said moving receptor element is a paper web.

* * * * *